United States Patent [19]

Cavagna et al.

[11] 4,406,648

[45] Sep. 27, 1983

[54] CREASING MACHINE

[76] Inventors: Elio Cavagna, via Milano 13, San Zenone al Lambro; Antonio Colombo, via Lomeni 4, Magenta, both of Italy

[21] Appl. No.: 300,293

[22] Filed: Sep. 8, 1981

[30] Foreign Application Priority Data

Sep. 29, 1980 [IT] Italy ..... 25005 A/80

[51] Int. Cl.[3] ..... B31B 1/25

[52] U.S. Cl. ..... 493/403; 83/881; 83/506; 493/161

[58] Field of Search ..... 493/403, 402, 401, 400, 493/161, 160, 60, 66, 371, 370; 83/506, 505, 503, 507, 881

[56] References Cited

U.S. PATENT DOCUMENTS

| | | | |
|---|---|---|---|
| 1,611,734 | 12/1926 | Gamm et al. | 493/401 X |
| 2,712,852 | 7/1955 | Carter | 83/506 X |
| 3,917,255 | 11/1975 | Watrous | 493/403 X |
| 4,257,298 | 3/1981 | Aykut | 83/506 X |

FOREIGN PATENT DOCUMENTS

| | | | |
|---|---|---|---|
| 1163657 | 2/1964 | Fed. Rep. of Germany | 83/506 |
| 2074492 | 11/1981 | United Kingdom | 83/506 |

*Primary Examiner*—James F. Coan

*Attorney, Agent, or Firm*—Allison C. Collard; Thomas M. Galgano

[57] ABSTRACT

Improved creasing machine, particularly for use in industry of cardboard articles and packages, comprising a sliding creasing roller and a fixed or stationary counter-roller, wherein the creasing roller is driven by the pistons of pneumatic, hydraulic or fluid-dynamic cylinders having the same axis of translation but different stroke.

5 Claims, 4 Drawing Figures

1
2
3
4
5
6
7
8
9
10
11
12
13

CREASING MACHINE

BACKGROUND OF THE INVENTION

1. Field of the Invention

This invention relates to an improved creasing machine, particularly for use in the industry of cardboard articles and packages.

2. Description of the Prior Art

As well known, creasing machines comprise two rollers: that is, a creasing roller, peripherally carrying the creasing impression, and a fixed or stationary counter-roller. The corrugated board, or in any case the laminate to be creased, is caused to pass between said rollers where it is creased. Depending on the thickness of the cardboard to be creased, the distance or spacing between the two rollers is adjusted, so that the cardboard or other material is subjected to the correct pressure.

As the position of the counter-roller is fixed, generally the position of the creasing roller will be varied for setting up thereof. The position of said creasing roller is maintained unaltered for all the same processing and the same thickness of the product to be creased.

In order to vary the distance or spacing of the creasing roller relative to the fixed counter-roller, use is generally made of mechanical controls, screw or thread controls, with cams, wedges and other mechanical mechanisms that the operator should manually position and regulate. As a result, the setting up operation of the machine is time wasting, hardworking and not always accurate, in addition to requiring skilled staff. Moreover, the creasing machine is structurally cumbersome and complicated, and accordingly costly.

OBJECTS OF THE INVENTION

It is the object of the present invention to provide a creasing machine without the above referred to disadvantages. More particularly, it is the object of the present invention to provide a creasing machine in which the change in distance or spacing between the creasing roller and the fixed counter-roller can be rapidly, accurately and automatically carried out.

SUMMARY OF THE INVENTION

According to the present invention, these objects are accomplished by an improved creasing machine comprising: a creasing roller, a fixed counter-roller, an axially movable fork supporting the creasing roller and integral with a sliding shaft, a sliding chamber for said shaft, a resilient means acting on the shaft maintaining the creasing roller at position of maximum distance or spacing relative to the fixed counter-roller, and a plurality of approach cylinders, coaxial and arranged in aligned sequence, the pistons of which slide along the same axis coincident with the axis of slide of the shaft and have different stroke.

Each of the pistons receive the thrust due to the pressure of air or fluid introduced into the cylinder through a nozzle formed laterally of the cylinder.

The introduction of fluid and resulting activation of one piston instead of another can be effected by a valve or electrovalve.

The axial translations of the fork shaft, and accordingly of the creasing roller, are provided by the direct or indirect action of one of the pistons on the fork shaft, against the resilient means. As the stroke of each piston is different, the operation of either piston enables to provide different translations of the shaft, and accordingly of the creasing roller. As a result, by presetting the stroke for each piston, quite accurate and reproduceable distances can be obtained between the creasing roller and fixed counter-roller, with the operation of each piston.

DESCRIPTION OF THE DRAWINGS

The constructive and functional characteristics of the creasing machine according to the present invention can be more clearly understood from the following description, with reference to the figures of the accompanying drawing schematically showing, by mere way of unrestrictive example, one of the possible embodiments. Of course, any other embodiment inspired to the same inventive concepts or actuating, also in different combination, the characteristics of the present invention, is within the covering field of the present invention.

In the accompanying drawing.

DETAILED DESCRIPTION OF THE PREFERRED EMBODIMENT

Figures 1, 2, 3, 4:
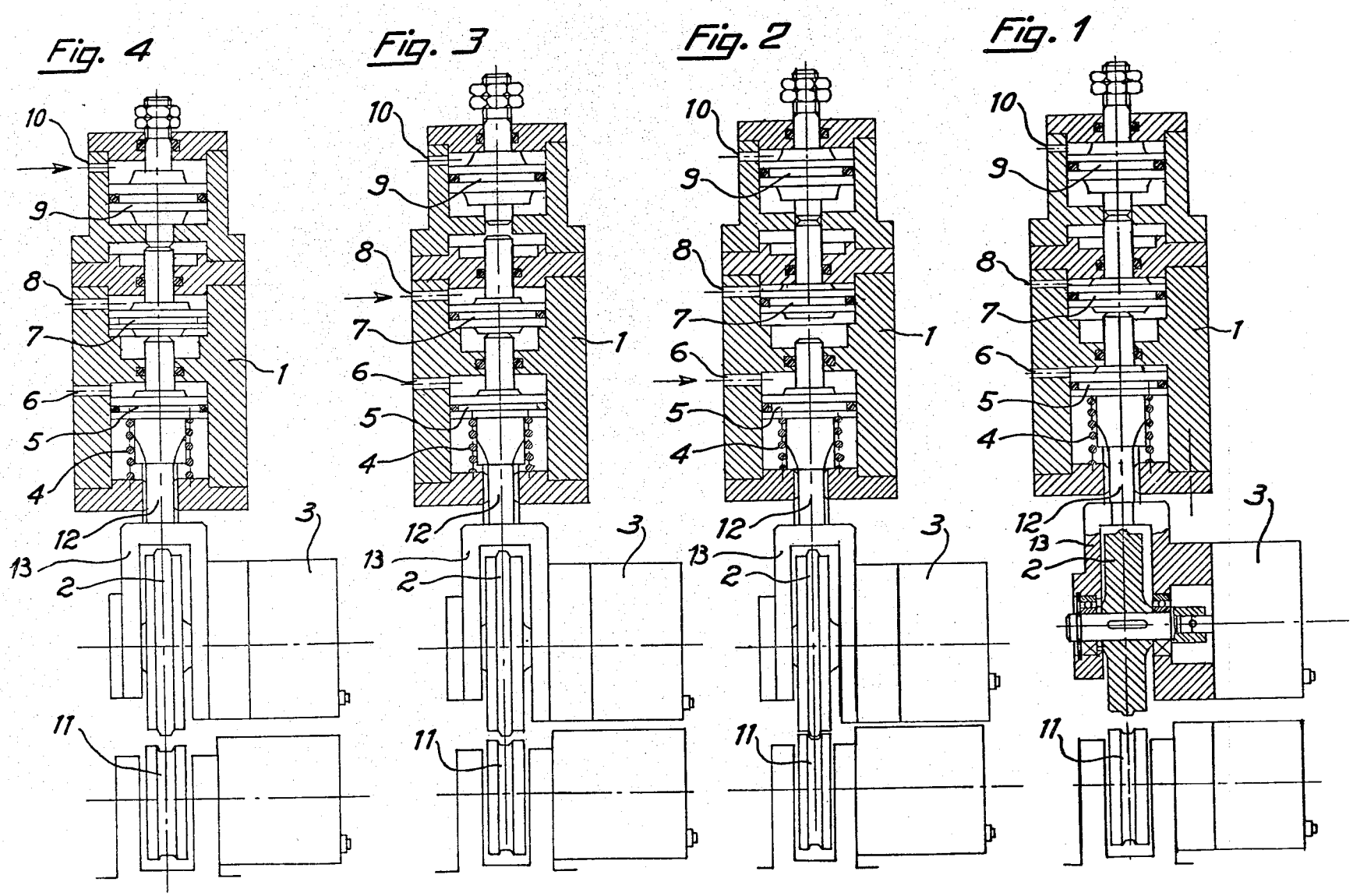
FIG. 1 is a diagrammatic vertical sectional view showing the creasing machine of the invention at rest position.
FIG. 2 is the same diagrammatic view of the creasing machine as that of FIG. 1 adjusted, for example, for working cardboard or other laminate 1.5 mm thick.
FIG. 3 is the same diagrammatic view as the preceding figures, in which the machine has been regulated, for example, for working cardboard 3.5 mm thick.
FIG. 4 is the same diagrammatic view as the preceding figures, in which the machine has been regulated, for example, for working cardboard 5 mm thick.

Referring to the figures of the accompanying drawing, the creasing machine according to the present invention comprises a support 1, a creasing roller 2 and a counter-roller 11. The roller 2 may be driven by a motor 3, according to well known techniques.

The creasing roller 2 is rotatably carried by a fork, which is provided with a sliding broached shaft 12. The distance or spacing between the two rollers 2 and 11 is determined by this shaft 12 which, by moving along its longitudinal axis, draws said fork 13 and accordingly the roller 2 moving it near to or away from the counter-roller 11.

In the industry of corrugated board, where cardboards of different thickness have to be creased, all what is needed for moving and dwelling the shaft 12 at one of the preselected operative positions, is already prearranged within said support 1.

Internally, said support 1 is divided into a plurality of chambers, each of which containing a sliding piston operated by the pressure of air or other fluid introduced into the chamber under the control of valves or electrovalves, through admission nozzles. Each piston has a different stroke, so that by acting on the valve of a chamber the corresponding piston is operated, which directly or indirectly acts upon the shaft 12 and moves the roller 2 by a well defined amount, corresponding to its stroke. As a result, by setting the piston stroke, the displacement of the creasing roller 2 is set.

A spring 4 serves the purpose of holding the shaft 12 at raised or lifted position, that is of maximum distance or spacing between said creasing roller 2 and counter-roller 11.

Four positions are shown in the appended drawing, namely: a rest position (FIG. 1); and three operating positions (FIGS. 2, 3 and 4).

At rest position (FIG. 1), no air or other fluid is introduced into the chambers, and accordingly said spring 4 upwardly urges said shaft 12 to a position of maximum distance or spacing between said roller 2 and counter-roller 11, for example 5 mm, where the maximum thickness of the cardboard is 5 mm. Of course, such a maximum distance or spacing could be higher and would depend on the thickness of the cardboard to be creased.

To crease cardboard 1.5 mm thick (FIG. 2), compressed air is introduced into the nozzle 6, the piston 5, formed integrally with shaft or rod 12, is downwardly urged, urging said shaft 12, fork 13 and creasing roller 2, so that the creasing distance is 1.5 mm.

To crease cardboard 3.5 mm thick (FIG. 3), compressed air or other fluid is introduced into the nozzle 8, the piston 7 is lowered to end of stroke and, by acting on shaft 12, through the piston of the underlying chamber, will bring the creasing roller 2 to a creasing distance of 3.5 mm.

To crease cardboard 5 mm thick (FIG. 4), compressed air or other fluid is introduced into the nozzle 10; the piston 9 is lowered to end of stroke, and by acting on shaft 12, through the two underlying pistons, will bring the creasing roller 2 to a creasing distance of 5 mm.

To determine or change the distances between the creasing roller and counter-roller, it will suffice to operate the valve supplying the fluid to either chamber.

What we claim is:

1. An improved creasing machine, particularly for use in the industry of cardboard articles and packages, comprising a creasing roller, a fixed counter-roller, an axially movable fork supporting the creasing roller and integral with a sliding shaft, a sliding chamber for said shaft, a resilient means acting on the shaft maintaining the creasing roller at position of maximum distance or spacing relative to the fixed counter-roller, and a plurality of approach cylinders, which are coaxial and arranged in aligned sequence, the pistons of which slide along the same axis, coinciding with the slide axis of the shaft, and have different stroke.

2. An improved creasing machine according to claim 1, wherein the stroke of each piston is correlated with the desired distance between the creasing roller and the counter-roller.

3. An improved creasing machine according to claim 2, wherein there are three pistons and at the end of stroke of each piston a distance is obtained between the rollers of 1.5; 3.5 and 5.0 mm, respectively.

4. An improved creasing machine according to claim 1, wherein each piston receives the thrust due to the pressure of air or a fluid introduced into the cylinder through a nozzle on the surface of the cylinder.

5. An improved creasing machine according to claim 1, wherein a valve or electrovalve controls the admission of air or fluid into each chamber, actuating the corresponding piston.

* * * * *